US008666736B2

(12) United States Patent
Haulick et al.

(10) Patent No.: US 8,666,736 B2
(45) Date of Patent: Mar. 4, 2014

(54) NOISE-REDUCTION PROCESSING OF SPEECH SIGNALS

(75) Inventors: Tim Haulick, Blaubeuren (DE); Mohamed Krini, Ulm (DE); Shreyas Paranjpe, Vancouver (CA); Gerhard Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 995 days.

(21) Appl. No.: 12/537,749

(22) Filed: Aug. 7, 2009

(65) Prior Publication Data

US 2010/0036659 A1 Feb. 11, 2010

(30) Foreign Application Priority Data

Aug. 7, 2008 (EP) ..... 08014151

(51) Int. Cl.
*G10L 21/00* (2013.01)

(52) U.S. Cl.
USPC ..... 704/226; 704/228; 704/233; 381/94.3

(58) Field of Classification Search
USPC ..... 704/226, 228, 233
See application file for complete search history.

(56) References Cited

U.S. PATENT DOCUMENTS

| | | | | |
|---|---|---|---|---|
| 6,163,608 | A * | 12/2000 | Romesburg et al. | 379/406.01 |
| 6,445,801 | B1 * | 9/2002 | Pastor et al. | 381/94.2 |
| 2002/0035471 | A1 | 3/2002 | Breton | 704/233 |
| 2008/0085012 | A1 * | 4/2008 | Matsuo | 381/94.3 |

FOREIGN PATENT DOCUMENTS

| | | | | |
|---|---|---|---|---|
| DE | 10 2004 012 209 A1 | 10/2005 | | G10L 21/02 |
| EP | 1 258 715 B1 | 11/2002 | | G01L 13/00 |
| JP | 02007011124 A * | 1/2007 | | |

OTHER PUBLICATIONS

European Patent Office European Search Report, Application No. 0801415.8-2225; Dec. 23, 2008.

Kuroiwa, S., et al. "Wind Noise Reduction Method for Speech Recording Using Multiple Noise Templates and Observed Spectrum Fine Structure," *IEEE*, Nov. 1, 2006, pp. 1-5.

Nishimura, Y., et al. "Speech Recognition for a Humanoid With Motor Noise Utilizing Missing Feature Theory,"*IEEE*, Dec. 1, 2006, pp. 26-33.

* cited by examiner

*Primary Examiner* — Vincent P Harper

(74) *Attorney, Agent, or Firm* — Sunstein Kann Murphy & Timbers LLP

(57) ABSTRACT

The present invention relates to a method for signal processing comprising the steps of providing a set of prototype spectral envelopes, providing a set of reference noise prototypes, wherein the reference noise prototypes are obtained from at least a sub-set of the provided set of prototype spectral envelopes, detecting a verbal utterance by at least one microphone to obtain a microphone signal, processing the microphone signal for noise reduction based on the provided reference noise prototypes to obtain an enhanced signal and encoding the enhanced signal based on the provided prototype spectral envelopes to obtain an encoded enhanced signal.

22 Claims, 3 Drawing Sheets

NOISE-REDUCTION PROCESSING OF SPEECH SIGNALS

PRIORITY

The present U.S. patent application claims priority form European Patent Application No. 08014151.8 filed on Aug. 7, 2008, which is incorporated herein by reference in its entirety.

FIELD OF INVENTION

The present invention relates to the art of electronically mediated verbal communication, in particular, by means of hands-free sets that, for instance, are installed in vehicular cabins. The invention is particularly directed to the pre-processing of speech signals before speech codec processing.

BACKGROUND OF THE INVENTION

Two-way speech communication of two parties mutually transmitting and receiving audio signals, in particular, speech signals, often suffers from deterioration of the quality of the audio signals caused by background noise. Hands-free telephones provide comfortable and safe communication systems of particular use in motor vehicles. However, perturbations in noisy environments can severely affect the quality and intelligibility of voice conversation, e.g., by means of mobile phones or hands-free telephone sets that are installed in vehicle cabins, and can, in the worst case, lead to a complete breakdown of the communication.

Consequently, some noise reduction must be employed in order to improve the intelligibility of electronically mediated speech signals. In particular, in the case of hands-free telephones, it is mandatory to suppress noise in order to guarantee successful communication. In the art, noise reduction methods employing Wiener filters or spectral subtraction are well known. For instance, speech signals are divided into sub-bands by some sub-band filtering module and a noise reduction algorithm is applied to each of the frequency sub-bands.

However, the intelligibility of speech signals and quality of hands-free communication is still not improved sufficiently when perturbations, e.g., caused by driving and rolling noise of vehicles at high speeds, are relatively strong resulting in a relatively low signal-to-noise ratio. In particular, at transitions from verbal utterances (speech activity) to speech pauses after the encoding and decoding of speech employed in the transmission of speech from a near party to a remote party communication suffers from severe artifacts known as the gating effect. Thus, there is a need for an improved method and system for noise reduction in electronic speech communication, in particular, in the context of hands-free sets.

SUMMARY OF THE INVENTION

A signal processing system for reducing noise within an automotive cabin during a telephone call is disclosed. The system reduces the noise by first providing a set of prototype spectral envelopes. A set of reference noise prototypes are also provided, wherein the reference noise prototypes are obtained from at least a sub-set of the provided set of prototype spectral envelopes. The signal processing system detects a verbal utterance by at least one microphone to obtain a microphone signal. The microphone signal is processed for noise reduction based on the provided reference noise prototypes to obtain an enhanced signal. The enhanced signal is encoded based on the provided prototype spectral envelopes to obtain an encoded enhanced signal.

Spectral envelopes are commonly used in the art of speech signal processing, speech synthesis, speech recognition etc. (see, e.g., Y. Griffin and J. S. Lim, "Multi-Band Excitation Vocoder", IEEE Transactions Acoustical Speech Signal Processing, Vol. 36, No. 8, pages 1223-1235, 1988).

In the art, speech signals to be transmitted from a near party to a remote party, e.g., by hands-free telephony, are enhanced by noise reduction that does not consider the subsequent codec (encoding and decoding) processing of the noise-reduced signals which is performed in telephony communication. Contrary, in the present invention codec processing is taken into account and it is aimed to provide speech signals that show a significantly enhanced quality after both signal processing for noise reduction and codec processing.

This object is achieved by providing reference noise prototypes and noise-reduction of the processed speech signals based on the provided reference noise prototypes. The prototypes are predetermined such that subsequent codec processing does not severely affect the quality of the speech signals decoded and output at the end of some remote party that received the noise-reduced and encoded speech signals. This is particularly achieved by providing reference noise prototypes that are obtained from, e.g., chosen from, at least a sub-set of the provided set of prototype spectral envelopes. Thereby, artifacts that affect the intelligibility of speech signals after processing for noise reduction and encoding/decoding can be suppressed.

The reference noise prototypes can, in particular, be spectral envelopes modeled by an all-pole filter function. For instance, the reference noise prototypes may be chosen from the prototype spectral envelopes of a speech codec.

The provided set of prototype spectral envelopes may particularly be used for the encoding of the enhanced signal in speech pauses detected in the microphone signal or when a signal-to-noise ratio of the microphone signal falls below a predetermined threshold (see also detailed discussion below). In particular, the disturbing so-called gating effect can efficiently be suppressed by the herein disclosed method for signal processing.

The speech encoding of the enhanced signal (and corresponding decoding on a receiver side) can be performed by any method known in the art, e.g., Enhanced Variable Rate Codec (EVRC) and Enhanced Full Rate Codec (EFRC) (see also detailed discussion below).

The above-described method according to an embodiment comprises transmitting the encoded enhanced signal to a remote party, receiving the transmitted encoded enhanced signal by the remote party and decoding the received signal by the remote party. The quality of the speech signal after decoding by the remote party is significantly enhanced as compared to the art, since the noise reduction of the microphone signal at the near side takes into account the subsequent encoding/decoding by the provided reference noise prototypes.

According to a further embodiment, the processing of the microphone signal for noise reduction can be achieved by estimating the power density of a noise contribution in the microphone signal. The spectrum of the noise contribution obtained from the estimated power density of the noise contribution is matched with the provided set of reference noise prototypes to find the best matching reference noise prototype. The best matching reference noise prototype is then used for noise reduction of the microphone signal.

The best matching reference noise prototype is particularly used to determine maximum damping factors for a noise reduction characteristics of the noise reduction filtering module employed for noise reduction of the microphone signal. By this procedure it is achieved that noise reduction is based on the best matching reference noise prototype, i.e., the subsequent encoding is taken very suitably into account in the noise reduction process.

In general, the best matching reference noise prototype will change with time. In order to avoid associated abrupt changes in the maximum damping factors that might lead to disturbing artifacts, switching from one best matching reference noise prototype to another for determining the maximum damping factors might be performed in a smoothed manner. An example for a smooth transition from one reference noise prototype used for the noise reduction processing to another is described in the detailed description below.

In particular, the processing of the microphone signal for noise reduction can be performed by a Wiener-like filtering module comprising damping factors obtained based on the best matching reference noise prototype, the power density spectrum of sub-band signals obtained from the microphone signal and the estimated power density spectrum of the background noise. Employment of some Wiener characteristics allows for reliable noise reduction and fast convergence of standard algorithms for the determination of the filter coefficients (damping factors). The details for the determination of the damping factors are described in the detailed description below.

Moreover, it might be preferred that the spectrum of the noise contribution obtained from the estimated power density of the noise contribution is matched only with a subset of the provided reference noise prototypes within a predetermined frequency range, e.g., ranging from 300-700 Hz. This is advantageous, since the actual noise may differ largely from the provided reference spectra in low frequencies. Restricting the search for the best matching reference noise prototype to some predetermined frequency significantly accelerates the processing.

Furthermore, it is provided a method for speech communication with a hands-free set installed in a vehicle, particular, an automobile, comprising the method according to one of the preceding claims, wherein at least one of the provided reference noise prototypes on which the processing of the microphone signal for noise reduction to obtain an enhanced signal is based is determined from a sub-set of the provided set of reference noise prototypes that is selected according to a current (presently measured) traveling speed of the vehicle, in particular, the automobile; and/or the reference noise prototypes are obtained from a sub-set of the provided set of prototype spectral envelopes selected according to the type of the vehicle, in particular, the automobile.

According to this example, the computation load is reduced as compared to the previous examples. For example, only a reduced number of reference noise prototypes has to be considered in finding the one that best matches the background noise spectrum depending on the type of the vehicle, in particular, the automobile, e.g., depending on the brand of an automobile or characteristics of the engine, etc. Further, depending on the traveling speed particular prototype spectral envelopes might be typically used for the speech codec processing and these envelopes are advantageously used for the noise reduction. Thus, other reference noise prototypes can be ignored thereby reducing the demand for computational resources.

The present invention, moreover, can be incorporated in a computer program product comprising at least one computer readable medium having computer-executable instructions for performing one or more steps of the method according to one of the above-described embodiments when run on a computer.

The above-mentioned problem is also solved by a signal processing system that includes an encoding database comprising prototype spectral envelopes and a reference database comprising reference noise prototypes, wherein the reference noise prototypes are obtained from at least a sub-set of the provided set of prototype spectral envelopes. A noise reduction filtering module processes a microphone signal comprising background noise based on the reference noise prototypes to obtain an enhanced microphone signal. The enhanced microphone signal is then encoded by an encoder based on the prototype spectral envelopes.

In particular, the reference noise prototypes may be a subset of the provided set of prototype spectral envelopes. According to an embodiment, the signal processing system further includes a noise estimating module configured to estimate the power density of a background noise contribution of the microphone signal. Additionally, the signal processing system includes a matching module that is configured to match the spectrum of the noise contribution obtained from the estimated power density of the noise contribution with the set of reference noise prototypes comprised in the reference database to find the best matching reference noise prototype. Further still the system may include a noise reduction filtering module that is configured to use the best matching reference noise prototype for noise reduction of the microphone signal.

The noise reduction filtering module may be a Wiener-like filter comprising damping factors based on the best matching reference noise prototype, the power density spectrum of microphone sub-band signals obtained from the microphone signal and the estimated power density spectrum of the background noise present in the microphone signal.

In particular, the noise reduction filtering module may be configured to operate in the sub-band regime and to output noise-reduced microphone sub-band signals and the signal processing system may further comprise an analysis filter bank configured to process the microphone signal to obtain microphone sub-band signals and to provide the microphone sub-band signals to the noise reduction filtering module. A synthesis filter bank is also included and is configured to process the noise-reduced microphone sub-band signals to obtain a noise-reduced full-band microphone signal in the time domain.

The signal processing system may be installed in an automobile and the reference database may be derived from the encoding database dependent on type of the automobile.

According to another embodiment one of the above-mentioned examples for the signal processing system according to the present invention further comprises a control module configured to control determination of at least one of the reference noise prototypes used by the noise reduction filtering module to process the microphone signal to obtain the enhanced microphone signal based on a current traveling speed of the automobile.

The signal processing module is particularly useful for a hands-free telephony set. Thus, it is provided a hands-free (telephony) set, in particular, installed in a vehicle, e.g. an automobile, comprising at least one microphone, in particular, a number of microphone arrays, at least one loudspeaker and a signal processing module according to one of the above examples of the inventive signal processing system. Moreover, herein it is provided an automobile with such a hands-free set installed in the compartment of the automobile.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Embodiments of the present invention are directed to signal processing systems and methods for reducing cabin noise within an automobile. The signal processing methodology may be embodied as computer program code that operates to reduce noise due to changing sound conditions within the automotive cabin. FIG. 1A is a flow chart that demonstrates the basic methodology. First a set of prototype spectral envelopes is provided. 100 The spectral envelopes may be stored in memory or in a database and retrieved by a processor. It should be recognized that the system and methodology may be implemented with one or more processors without diverging from the subject matter of the invention. The processor then retrieves from a memory location a set of reference noise prototypes. 110. The reference noise prototypes are obtained from at least a sub-set of the provided set of prototype spectral envelopes. The processor detects a verbal utterance by at least one microphone to obtain a microphone signal. 120 The microphone signal is processed for noise reduction based on the provided reference noise prototypes to obtain an enhanced signal. 130 The enhanced signal is encoded based on the provided prototype spectral envelopes to obtain an encoded enhanced signal. 140

Figure 1:
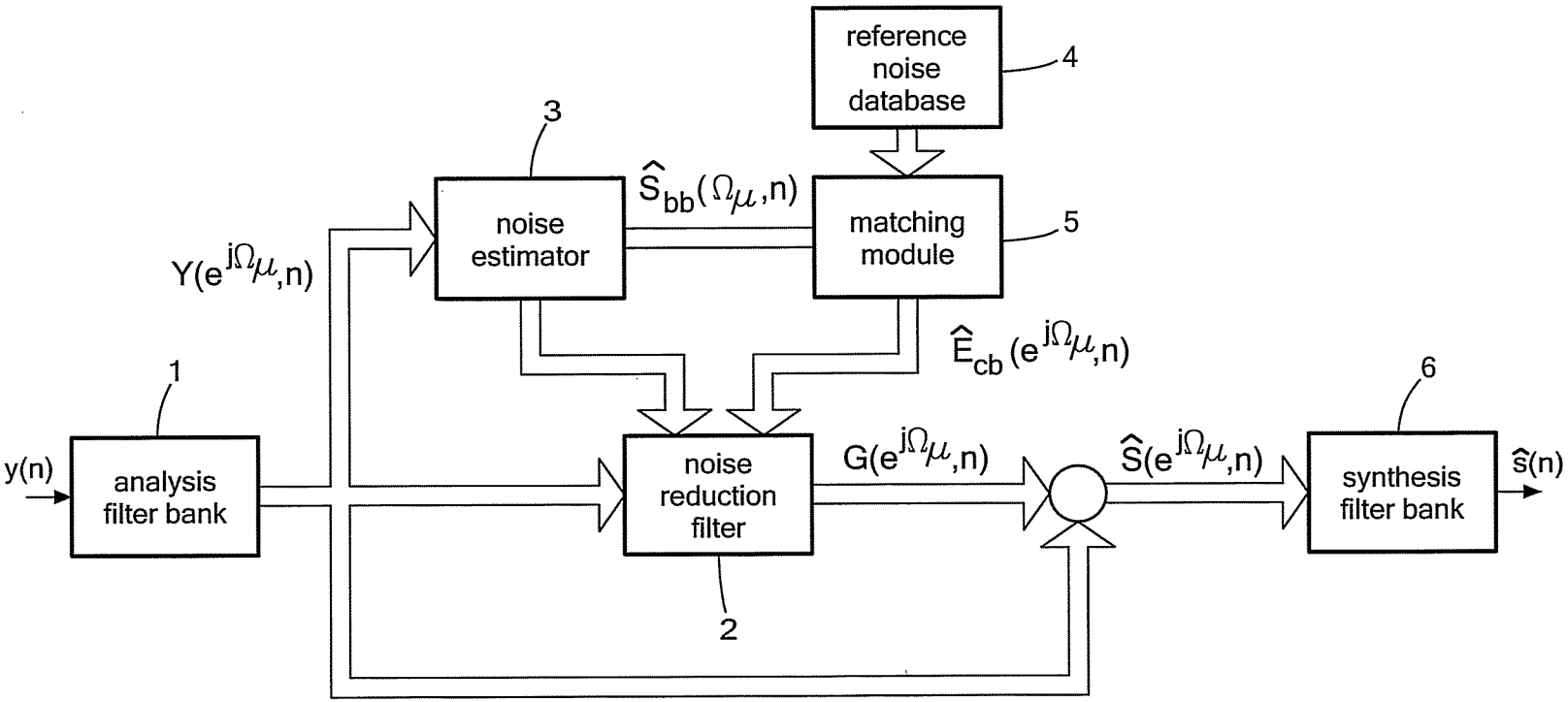
FIG. 1 illustrates an example of the processing of a microphone signal that is to be transmitted from a near party to a remote party according to the present invention including noise-reduction by means of reference noise prototypes.
Figure 1A:
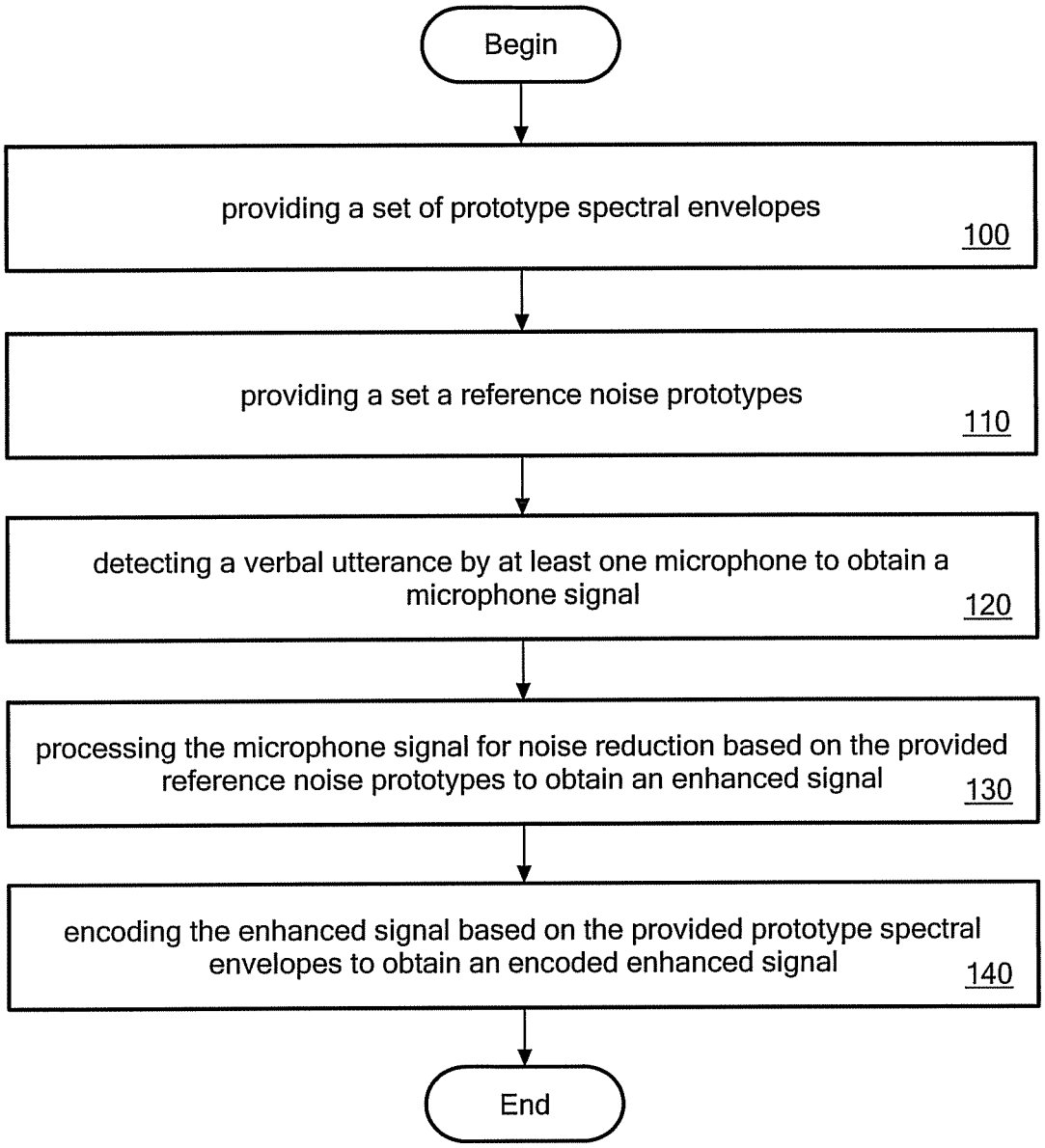
FIG. 1A is a flow chart that illustrates a method for signal processing a microphone signal.

In the example shown in FIG. 1 a microphone signal y(n) comprising speech s(n) and background noise b(n) (n being a discrete time index) is processed by an analysis filter bank 1 to achieve sub-band signals $Y(e^{j\Omega_\mu},n)$ where $\Omega_\mu$ denotes the mid-frequency of the μ-th frequency sub-band. Whereas in the following processing in the sub-band domain is described, alternatively the microphone signal could be subject to a Discrete Fourier Transformation, e.g., of the order of 256, in order to perform processing in the frequency domain. In this context, it should be noted that processing employing Bark or Mel grouping of frequency nodes might be preferred.

As illustrated in FIG. 1 the sub-band signals $Y(e^{j\Omega_\mu},n)$ are input in a noise reduction filtering module 2 that applies damping factors (filter coefficients) $G(e^{j\Omega_\mu},n)$ to each of the sub-band signals $Y(e\ e^{j\Omega_\mu},n)$ in order obtain enhanced sub-band signals, i.e., a noise reduced spectrum $\hat{S}(e^{j\Omega_\mu},n)=Y(e^{j\Omega_\mu},n)G(e^{j\Omega_\mu},n)$. The realization of the noise reduction filtering module 2 represents the kernel of the present invention.

In the art the damping factors $G(e^{j\Omega_\mu},n)$ of the noise reduction filtering module are determined depending on the present signal-to-noise ratio (SNR) and the noise reduction filtering module is realized by some Wiener filter or employs spectral subtraction, etc. Usually, the damping factors $G(e^{j\Omega_\mu},n)$ are determined based on an estimate of the short-time power density of the microphone signal $$\hat{S}_{yy}(\Omega_\mu,n)=|Y(e^{j\Omega_\mu},n)|^2$$

and an estimate of the power density of the background noise. The power density of the background noise is determined during speech pauses and might be temporarily smoothed $$\hat{S}_{bb}(\Omega_\mu,n)=\begin{cases}\lambda\hat{S}_{bb}(\Omega_\mu,n-1)+(1-\lambda)|Y(e^{j\Omega_\mu},n)|^2 & \text{in speech pauses,}\\ \hat{S}_{bb}(\Omega_\mu,n-1) & \text{else.}\end{cases}$$

wherein λ denotes the smoothing time constant $0\leq\lambda<1$.

However, in the art the processing of the microphone signal for noise reduction does not take into account subsequently performed codec processing. Codec processing is a mandatory component of signal processing in the context of telephony. Well-known codec methods comprise Enhanced Variable Rate Codec (EVRC) and Enhanced Full Rate Codec (EFRC). Present day speech codec algorithms are usually based on the source-filter model for speech generation wherein the excitation signal and the spectral envelope are determined (see, e.g., Y. Griffin and J. S. Lim, "Multi-Band Excitation Vocoder", IEEE Transactions Acoustical Speech Signal Processing, Vol. 36, No. 8, pages 1223-1235, 1988).

Unvoiced sound is synthesized by means of noise generators. Voiced parts of the microphone signal (speech signal) are synthesized by estimating the pitch and determining the corresponding signal of a provided excitation code book, extracting the spectral envelope (e.g., by Linear Prediction Analysis or cepstral analysis, see, Y. Griffin and J. S. Lim, "Multi-Band Excitation Vocoder", IEEE Transactions Acoustical Speech Signal Processing, Vol. 36, No. 8, pages 1223-1235, 1988) and determining the best matching spectral envelope of a provided spectral envelope code book.

Common codec processing usually employs several different code books from which entries are chosen and the number of different code books considered depends on the actual SNR. If the SNR is high, a large number of code books is used in order to model the excitation signal as well as the spectral envelope. If the SNR is low or during speech pauses, the speech encoding rate is low and a relatively small number of code books is used.

The codec processing may significantly affect the quality of the noise reduced microphone signals. In the case of hands-free telephony in automobiles the codec processing can result in poor intelligibility of the speech signals sent to and received by a remote communication party when the traveling speed is high. Thus, even when the noise reduction processing itself is successful, the quality of the transmitted/received speech signal can be relatively poor.

In view of this, according to the present invention the noise reduction filtering module 2 is operated taking into account subsequent codec processing. In particular, the noise reduction filtering module 2 is adapted based on a variety of predetermined reference noise spectra that can be processed by the subsequent codec without generating disturbing artifacts, particularly, at transitions from speech activity and speech pauses. It is particularly advantageous to choose spectral envelopes used by the codec processing for low SNR or during speech pauses for the reference noise spectra.

The spectral envelopes can be described by an all-pole filter as it is known in the art $$E_{cb}(e^{j\Omega_\mu},m)=\frac{1}{1-\sum_{k=1}^{P}a_k(m)e^{-j\Omega_\mu k}},\ m\in\{0,\ldots,L-1\}$$

where $a_k(m)$ denotes the predictor coefficients (LPCs) which are used for modeling a spectral envelope during the speech codec processing and L represents the number of different predetermined reference noise spectra provided in the present example of the inventive method.

A noise estimator 3 estimates the power density $\hat{S}_{bb}(\Omega_\mu,n)$ of the background noise that is present in the microphone sub-band signals $Y(e^{j\Omega_\mu},n)$. As shown in FIG. 1*a* database 4 comprising reference noise spectra is provided and by a matching module 5 the particular one of the predetermined reference noise spectra is determined that matches best the estimated spectrum of the background noise $$\hat{B}(e^{j\Omega_\mu},n)=\sqrt{\hat{S}_{bb}(\Omega_\mu,n)}.$$

Since the background noise may be highly temporally varying, smoothing in frequency in the positive direction $$\overline{B}'(e^{j\Omega_\mu},n)=\begin{cases}\hat{B}(e^{j\Omega_\mu},n), & \text{for } \mu=0,\\ \lambda_F\overline{B}'(e^{j\Omega_{\mu-1}},n)+(1-\lambda_F)\hat{B}(e^{j\Omega_\mu},n), & \text{for } \mu\in\{1,\ldots,M-1\},\end{cases}$$

followed by smoothing in the negative direction $$\overline{B}(e^{j\Omega_\mu},n)=\begin{cases}\overline{B}'(e^{j\Omega_\mu},n), & \text{for } \mu=M-1,\\ \lambda_F\overline{B}(e^{j\Omega_{\mu+1}},n)+(1-\lambda_F)\overline{B}'(e^{j\Omega_\mu},n), & \text{for } \mu\in\{0,\ldots,M-2\},\end{cases}$$

with a smoothing parameter $\lambda_F$ smaller than 1, in particular, smaller than 0.5, e.g., $\lambda_F=0.3$, might be performed.

According to the present example, both the smoothed estimated noise spectrum and the reference noise spectra are logarithmized $$\overline{B}_{log}(e^{j\Omega_\mu},n)=20\log_{10}\{\overline{B}(e^{j\Omega_\mu},n)\}$$

and $$E_{cb,log}(e^{j\Omega_\mu},m)=20\log_{10}\{E_{cb}(e^{j\Omega_\mu},m)\},$$

respectively.

Since the actual noise may differ significantly from the reference noise spectra at low frequencies, it might be preferred to restrict the search for the best matching reference noise spectrum stored in the database 4 to a middle frequency range. For instance, sub-band signals for frequencies below some predetermined threshold $\Omega_{\mu 0}$, e.g. below some hundred Hz, in particular, below 300-700 Hz, more particularly, below 500 Hz might be ignored for the search. In addition, sub-band signals for frequencies above some predetermined threshold $\Omega_{\mu 1}$, e.g., some thousand Hz, in particular, for frequencies above 3000 or 3500 Hz, might be ignored for good matching results depending on the actual application.

In order to avoid that the search is affected by different gains/volumes of the noise, the logarithmic mean is subtracted from the smoothed estimated noise spectrum $$\overline{B}_{log,u}(e^{j\Omega_\mu},n)=\overline{B}_{log}(e^{j\Omega_\mu},n)-\overline{B}_{log,m}(n)$$

with $$\overline{B}_{log,m}(n)=\frac{1}{\mu_1-\mu_0+1}\sum_{\mu=\mu 0}^{\mu 1}\overline{B}_{log}(e^{j\Omega_\mu},n).$$

Moreover, the logarithmic mean value of the reference noise spectra for the chosen frequency range is subtracted from the reference noise spectra $$E_{cb,log,\mu}(e^{j\Omega_\mu},m)=E_{cb,log}(e^{j\Omega_\mu},m)-E_{cb,log,m}(m)$$

with $$E_{cb,log,m}(m)=\frac{1}{\mu_1-\mu_0+1}\sum_{\mu=\mu 0}^{\mu 1}E_{cb,log}(e^{j\Omega_\mu},m).$$

The search for the best matching one of the reference noise spectra can, e.g., be performed based on a logarithmic distance norm $$m_{opt}(n)=\underset{m}{\operatorname{argmin}}\sum_{\mu=\mu 0}^{\mu 1}(\overline{B}_{log,u}(e^{j\Omega_\mu},n)-E_{cb,log,u}(e^{j\Omega_\mu},m))^2.$$

Other cost functions based, for instance, on the cepstral or LPC distance norm, might be employed for the search for the best matching reference noise spectrum that is carried out by the matching module 5.

After the best matching reference noise spectrum has been determined, the power is adjusted. After linearization one obtains $$\hat{E}_{cb}(e^{j\Omega_\mu},n)=10^{(E_{cb,log,\mu}(e^{j\Omega_\mu},m_{opt}(n))+\overline{B}_{log,m}(m))/20}.$$

This spectrum is input in the noise reduction filtering module 2 by the matching module 5. It is noted that in the case of time-varying background noise, e.g., due to different driving situations in the context of a hands-free telephony set installed in an automobile, the matching results differ in time. Hard switching from one best matching reference noise spectrum to another shall be avoided in order not to generate disturbing artifacts. For instance, recursive smoothing may advantageously be employed $$\hat{E}_{cb,sm}(e^{j\Omega_\mu},n)=\gamma_z\hat{E}_{cb,sm}(e^{j\Omega_\mu},n-1)+(1-\gamma_z)\hat{E}_{cb}(e^{j\Omega_\mu},n)$$

with a time smoothing constant $0\le\gamma_z<1$.

In the noise reduction filtering module 2 the modified best matching reference noise spectrum input by the matching module 5 is adapted with respect to the total power density according to $$\tilde{E}_{cb}(e^{j\Omega_\mu},n)=G_{cor}(n)\hat{E}_{cb,sm}(e^{j\Omega_\mu},n)$$

with $$G_{cor}(n)=\begin{cases}\Delta_{inc}G_{cor}(n-1), & \text{if } \sum_{\mu=\mu 2}^{\mu 3}\tilde{E}_{cb}^2(e^{j\Omega_\mu},n-1)<\tilde{G}_{min}^2\sum_{\mu=\mu 2}^{\mu 3}\hat{S}_{bb}(\Omega_\mu,n)\\ \Delta_{dec}G_{cor}(n-1), & \text{else,}\end{cases}$$

wherein $\tilde{G}_{min}$ is a predetermined damping value for a predetermined frequency sub-band range $[\Omega_{\mu 2},\Omega_{\mu 3}]$ by which the reference noise shall fall below the actual background noise and wherein $\Delta_{inc}$ and $\Delta_{dec}$ are multiplicative correcting constants that satisfy the relation $$0<<\Delta_{dec}<1<\Delta_{inc}<<\infty.$$

Experiments have proven that suitable choices for $\Omega_{\mu 2}$ and $\Omega_{\mu 3}$ are $\Omega_{\mu 2}=500$ Hz and $\Omega_{\mu 3}=700$ Hz, respectively. Maximum damping factors depending on time and frequency can be determined based on the adapted reference noise spectrum according to $$G_{min}(e^{j\Omega_\mu}, n) = \min\left\{G_0, \frac{\tilde{E}_{cb}(e^{j\Omega_\mu}, n)}{|Y(e^{j\Omega_\mu}, n)|}\right\}$$

with the predetermined minimum damping $G_0$. A suitable choice for the minimum damping is $0.3<G_0<0.7$, in particular, $G_0=0.5$. The thus obtained time and frequency selective maximum damping factors are used for determining the filter characteristics of the noise reduction filtering module 2. For instance, a recursive Wiener filter characteristics may be employed according to $$G(e^{j\Omega_\mu}, n) = \max\left\{G_{min}(e^{j\Omega_\mu}, n), 1 - \beta(e^{j\Omega_\mu}, n)\frac{\hat{S}_{bb}(\Omega_\mu, n)}{\hat{S}_{yy}(\Omega_\mu, n)}\right\}$$

with real coefficients $\beta(e^{j\Omega_\mu},n)$.

The microphone sub-band signals $Y(e^{j\Omega_\mu},n)$ are filtered by the noise reduction filtering module 2 in order to obtain the noise reduced spectrum $\hat{S}(e^{j\Omega_\mu},n)=Y(e^{j\Omega_\mu},n)G(e^{j\Omega_\mu},n)$. The noise reduced spectrum $\hat{S}(e^{j\Omega_\mu},n)$ (noise reduced microphone sub-band signals) is input in a synthesis filter bank 6 to obtain the noise reduced total band signal s(n) in the time domain. Since this signal is obtained by means of the best matching reference noise spectrum of predetermined reference noise spectra that are also used for codec processing of the noise-reduced signal $\hat{s}(n)$, the overall quality of a speech signal (microphone signal) transmitted to a remote party is significantly enhanced as compared to the art. In particular, artifacts at transitions of speech activity to speech pauses (gating effect) are reduced.

It is to be understood that the noise reduction filtering module 2, the noise estimator 3 and the matching module 5 of FIG. 1 may or may not be realized in separate physical/processing units.

The signal processing described with reference to FIG. 1 can be part of a method for electronically mediated verbal communication between two or more communication parties. In particular, it can be realized in hands-free telephony, e.g., by means of a hands-free set installed in an automobile. As already discussed audio signal processing in the context of telephony not only comprises noise reduction of signals detected by microphones but also codec processing.

Figure 2:
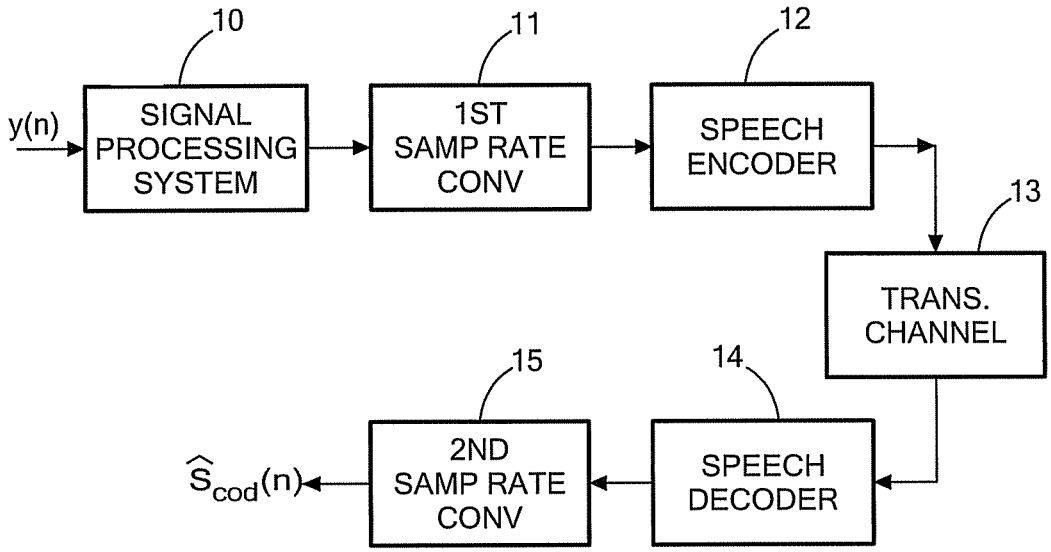
FIG. 2 illustrates an example of processing of a microphone signal according to the present invention including noise-reduction and encoding/decoding.

FIG. 2 illustrates an example of a method of processing a microphone signal y(n) in order to obtain a encoded/decoded speech signal that is provided to a remote communication party. Consider a situation in that a near communication party makes use of a hands-free set installed in a vehicular cabin. The hands-free set comprises one or more microphones that detect the utterance of a user, i.e. a driver or other passenger sitting in the vehicular cabin. A microphone signal y(n) corresponding to the utterance but also including some background noise is obtained by means of the at least one microphone.

This microphone signal y(n) is processed as described with reference to FIG. 1 in order to obtain an enhanced microphone signal (speech signal) s(n). The reference sign 10 in FIG. 2 denotes a signal processing system comprising the analysis filter bank 1, noise reduction filtering module 2, noise estimator 3, reference noise database 4, matching module 5 and synthesis filter bank 6 of FIG. 1. The enhanced signal s(n) is transmitted from the near party to a remote party by codec processing, e.g., EVRC or EFRC. Since the sampling rate of the speech encoding according to the present example is different from the sampling rate of the enhanced signal s(n) a first module for sampling rate conversion 11 adapts the sampling rate of s(n) to the one of the speech encoding performed by a speech encoder 12.

The encoded signal is wirelessly transmitted via some transmission channel 13 to a remote communication party. At the remote side a speech decoder 14 decodes the coded signal as known in the art and synthesizes a speech signal to be output by a loudspeaker. The decoded signal is subject to sampling rate conversion by a second module for sampling rate conversion 15 located at the remote site. The second module for sampling rate conversion 15 can, e.g., process the transmitted and decoded signal for bandwidth extension. Eventually, the re-sampled decoded signal $\hat{s}_{cod}(n)$ is output to a remote user.

Since noise-reduction of the microphone signal y(n) by the module 10 of FIG. 2 is carried out based on reference noise spectra that are also used for the codec processing, the quality of the output signal $\hat{s}_{cod}(n)$ is significantly enhanced as compared to conventional noise reduction and codec processing of a speech signal to be transmitted from a near communication party to a remote communication party.

All previously discussed embodiments are not intended as limitations but serve as examples illustrating features and advantages of the invention. It is to be understood that some or all of the above described features can also be combined in different ways.

It should be recognized by one of ordinary skill in the art that the foregoing methodology may be performed in a signal processing system and that the signal processing system may include one or more processors for processing computer code representative of the foregoing described methodology. The computer code may be embodied on a tangible computer readable medium i.e. a computer program product.

The present invention may be embodied in many different forms, including, but in no way limited to, computer program logic for use with a processor (e.g., a microprocessor, microcontroller, digital signal processor, or general purpose computer), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof. In an embodiment of the present invention, predominantly all of the reordering logic may be implemented as a set of computer program instructions that is converted into a computer executable form, stored as such in a computer readable medium, and executed by a microprocessor within the array under the control of an operating system.

Computer program logic implementing all or part of the functionality previously described herein may be embodied in various forms, including, but in no way limited to, a source code form, a computer executable form, and various intermediate forms (e.g., forms generated by an assembler, compiler, networker, or locator.) Source code may include a series of computer program instructions implemented in any of various programming languages (e.g., an object code, an assembly language, or a high-level language such as Fortran, C, C++, JAVA, or HTML) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. The computer program may be fixed in any form in a signal that is transmittable to a computer using any of various communication technologies, including, but in no way limited to, analog technologies, digital technologies, optical technologies, wireless technologies, networking technologies, and internetworking technologies. The computer program may be distributed in any form as a removable storage medium with accompanying printed or electronic documentation (e.g., shrink wrapped software or a magnetic tape), preloaded with a computer system (e.g., on system ROM or fixed disk), or distributed from a server or electronic bulletin board over the communication system (e.g., the Internet or World Wide Web.)

Hardware logic (including programmable logic for use with a programmable logic device) implementing all or part of the functionality previously described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL.)

The invention claimed is:

1. A method for signal processing comprising:

obtaining a set of common reference noise prototypes from at least a sub-set of a set of prototype spectral envelopes;

processing a microphone signal characterizing a verbal utterance for noise reduction to obtain an enhanced signal, the processing being based on the set of common reference noise prototypes; and encoding the enhanced signal to obtain an encoded enhanced signal, the encoding being based on the set of common reference noise prototypes.

2. The method according to claim 1, further comprising transmitting the encoded enhanced signal to a remote party;

receiving the transmitted encoded enhanced signal by the remote party; and decoding the received signal by the remote party.

3. The method according to claim 1, wherein the set of prototype spectral envelopes is used for encoding the enhanced signal in speech pauses detected in the microphone signal or when a signal-to-noise ratio of the microphone signal falls below a predetermined threshold.

4. The method according claim 1, wherein the common reference noise prototypes are spectral envelopes modeled by an all-pole filter function.

5. The method according to claim 1, wherein the processing of the microphone signal for noise reduction comprises:

estimating the power density of a noise contribution in the microphone signal;

matching the spectrum of the noise contribution obtained from the estimated power density of the noise contribution with the set of common reference noise prototypes to find the best matching reference noise prototype; and using the best matching reference noise prototype to determine maximum damping factors for noise reduction of the microphone signal.

6. The method according to claim 5, wherein the processing of the microphone signal for noise reduction is performed by a Wiener-like filtering module comprising damping factors obtained based on the best matching reference noise prototype, the power density spectrum of sub-band signals obtained from the microphone signal and the estimated power density spectrum of the background noise.

7. The method according to claim 5, wherein the spectrum of the noise contribution obtained from the estimated power density of the noise contribution is matched only with a subset of the set of common reference noise prototypes within a predetermined frequency range.

8. A method according to claim 1, wherein the microphone is part of a hands-free set installed in a vehicle and wherein at least one of the set of common reference noise prototypes on which the processing of the microphone signal for noise reduction to obtain an enhanced signal is determined from a sub-set of the set of common reference noise prototypes that is selected according to a current traveling speed of the vehicle, in particular, the automobile; and/or the set of common reference noise prototypes is obtained from a sub-set of the provided set of prototype spectral envelopes selected according to the type of the vehicle, in particular, the automobile.

9. A computer program product comprising a non-transitory computer readable medium having computer executable computer code thereon for processing a microphone signal, the computer code comprising:

computer code for obtaining a set of common reference noise prototypes from at least a sub-set of prototype spectral envelopes;

computer code for processing a microphone signal characterizing a verbal utterance for noise reduction to obtain an enhanced signal, the processing being based on the set of common reference noise prototypes; and computer code for encoding the enhanced signal to obtain an encoded enhanced signal, the processing being based on the set of common reference noise prototypes.

10. The computer program product according to claim 9, further comprising computer code for transmitting the encoded enhanced signal to a remote party;

computer code for receiving the transmitted encoded enhanced signal by the remote party; and computer code for decoding the received signal by the remote party.

11. The computer program product according to claim 9, wherein the set of prototype spectral envelopes is used for encoding the enhanced signal in speech pauses detected in the microphone signal or when a signal-to-noise ratio of the microphone signal falls below a predetermined threshold.

12. The computer program product according claim 9, wherein the set of common reference noise prototypes are spectral envelopes modeled by an all-pole filter function.

13. The method according to claim 9, wherein the computer code for processing of the microphone signal for noise reduction includes:

computer code for estimating the power density of a noise contribution in the microphone signal;

computer code for matching the spectrum of the noise contribution obtained from the estimated power density of the noise contribution with the set of common reference noise prototypes to find the best matching reference noise prototype; and computer code for using the best matching reference noise prototype to determine maximum damping factors for noise reduction of the microphone signal.

14. The computer program product according to claim 13, wherein the computer code for processing of the microphone signal for noise reduction is performed using a Wiener-like filter comprising damping factors obtained based on the best matching reference noise prototype, the power density spectrum of sub-band signals obtained from the microphone signal and the estimated power density spectrum of the background noise.

15. The computer program product according to claim 13, wherein the spectrum of the noise contribution obtained from the estimated power density of the noise contribution is matched only with a subset of the set of common reference noise prototypes within a predetermined frequency range.

16. A computer program product according to claim 9, wherein at least one of the set of common reference noise prototypes on which the processing of the microphone signal for noise reduction to obtain an enhanced signal is based is determined from a sub-set of the set of common reference noise prototypes that is selected according to a current traveling speed of the vehicle, in particular, the automobile; and/or the set of common reference noise prototypes is obtained from a sub-set of the set of prototype spectral envelopes selected according to the type of the vehicle, in particular, the automobile.

17. A signal processing system comprising:

an encoding database comprising prototype spectral envelopes;

a reference database comprising common reference noise prototypes, wherein the reference noise prototypes are obtained from at least a sub-set of the set of prototype spectral envelopes; and a noise reduction filtering module configured to process a microphone signal comprising background noise to obtain an enhanced microphone signal, the processing being based on the set of common reference noise prototypes; and an encoder configured to encode the enhanced microphone signal, the encoding being based on the set of common reference noise prototypes.

18. The signal processing system according to claim 17, further comprising a noise estimating module configured to estimate the power density of a background noise contribution of the microphone signal;

a matching module configured to match the spectrum of the noise contribution obtained from the estimated power density of the noise contribution with the set of common reference noise prototypes comprised in the reference database to find the best matching reference noise prototype; and wherein the noise reduction filtering module is configured to use the best matching reference noise prototype for noise reduction of the microphone signal.

19. The signal processing system according to claim 17, wherein the noise reduction filtering module uses a Wiener-like filter comprising damping factors obtained based on the best matching reference noise prototype, the power density spectrum of microphone sub-band signals obtained from the microphone signal and the estimated power density spectrum of the background noise.

20. The signal processing system according to claim 17, wherein the noise reduction filtering module is configured to operate in the sub-band regime and to output noise-reduced microphone sub-band signals; and further comprising an analysis filter bank configured to process the microphone signal to obtain microphone sub-band signals and to provide the microphone sub-band signals to the noise reduction filtering module; and a synthesis filter bank configured to process the noise-reduced microphone sub-band signals to obtain a noise-reduced full-band microphone signal in the time domain.

21. The signal processing system according to one of the claims 17, wherein the signal processing system is installed in an automobile and the reference database is derived from the encoding database dependent on type of the automobile.

22. The signal processing system according claim 17, further comprising:

a control module configured to control determination of at least one of the set of common reference noise prototypes used by the noise reduction filtering module to process the microphone signal to obtain the enhanced microphone signal based on a current traveling speed of the automobile.

* * * * *